US008044653B2

(12) United States Patent
Maige et al.

(10) Patent No.: US 8,044,653 B2
(45) Date of Patent: Oct. 25, 2011

(54) LOW DROP-OUT VOLTAGE REGULATOR

(75) Inventors: Philippe Maige, Seyssinet Pariset (FR); Yannick Guedon, Mimosa Park (SG)

(73) Assignee: STMicroelectronics SA, Montrouge (FR)

( * ) Notice: Subject to any disclaimer, the term of this patent is extended or adjusted under 35 U.S.C. 154(b) by 879 days.

(21) Appl. No.: 11/757,865

(22) Filed: Jun. 4, 2007

(65) Prior Publication Data

US 2008/0007231 A1 Jan. 10, 2008

(30) Foreign Application Priority Data

Jun. 5, 2006 (EP) ..... 06300559

(51) Int. Cl.
*G05F 3/16* (2006.01)

(52) U.S. Cl. ..... 323/313

(58) Field of Classification Search ..... 323/220, 323/223, 282, 226, 268, 273–275, 277, 280, 323/281, 312, 314; 313/313
See application file for complete search history.

(56) References Cited

U.S. PATENT DOCUMENTS

| | | | | |
|---|---|---|---|---|
| 5,528,127 | A * | 6/1996 | Streit | 323/269 |
| 5,828,208 | A * | 10/1998 | Oku | 323/282 |
| 6,304,131 | B1 | 10/2001 | Huggins et al. | |
| 6,333,623 | B1 | 12/2001 | Heisley et al. | |
| 6,452,766 | B1 | 9/2002 | Carper | |
| 6,677,735 | B2 * | 1/2004 | Xi | 323/273 |
| 6,703,815 | B2 * | 3/2004 | Biagi | 323/280 |
| 6,804,102 | B2 * | 10/2004 | Hamon et al. | 361/93.3 |
| 6,825,642 | B2 * | 11/2004 | Brooks | 323/272 |
| 6,861,827 | B1 * | 3/2005 | Yang et al. | 323/273 |
| 6,867,573 | B1 | 3/2005 | Carper | |
| 6,952,091 | B2 * | 10/2005 | Bansal | 323/277 |
| 7,109,897 | B1 * | 9/2006 | Levesque | 341/67 |
| 7,173,401 | B1 * | 2/2007 | Huang | 323/277 |
| 7,319,308 | B2 * | 1/2008 | Marino et al. | 323/222 |
| 7,554,304 | B2 * | 6/2009 | Kruiskamp et al. | 323/272 |
| 7,816,897 | B2 * | 10/2010 | Illegems | 323/277 |
| 2003/0178976 | A1 * | 9/2003 | Xi | 323/273 |
| 2003/0214275 | A1 * | 11/2003 | Biagi | 323/280 |
| 2004/0046532 | A1 * | 3/2004 | Menegoli et al. | 323/273 |
| 2008/0054867 | A1 * | 3/2008 | Soude et al. | 323/282 |
| 2008/0191670 | A1 * | 8/2008 | Oddoart et al. | 323/273 |

FOREIGN PATENT DOCUMENTS

EP 1365302 A1 11/2003

OTHER PUBLICATIONS

Dokania, R.K. et al., "Cancellation of load regulation in low drop-out regulators," Electronics Letters, vol. 38, No. 22, Oct. 24, 2002, pp. 1-2.

* cited by examiner

*Primary Examiner* — Adolf Berhane
*Assistant Examiner* — Yemane Mehari
(74) *Attorney, Agent, or Firm* — Lisa K. Jorgenson; Timothy L. Boller; Seed IP Law Group PLLC

(57) ABSTRACT

A low drop-out DC voltage regulator regulates a voltage from a DC supply and includes: a pass device controllable to maintain a voltage at an output of the regulator and arranged to provide a first current from the DC supply, at least part of said first current being provided to a load coupled to the output of the regulator; and a current regulator coupled to said pass device and to the output of the regulator. The current regulator is arranged to conduct a second current controllable such that the first current through said pass device remains constant irrespective of variations in a load current to said load.

36 Claims, 3 Drawing Sheets

LOW DROP-OUT VOLTAGE REGULATOR

BACKGROUND OF THE INVENTION

1. Field of the Invention

The present invention relates to a low drop-out voltage regulator and in particular to a low drop-out voltage regulator having a fast response time.

2. Description of the Related Art

Low drop-out (LDO) voltage regulators are used to provide a steady voltage level that is lower than the supply voltage level. Such regulators should be able to provide a steady voltage level at the same time as providing the current to a load.

A P-channel MOS transistor (PMOS) is generally used in LDO voltage regulators as the pass device connected between the supply voltage and the load connected to the output of the LDO circuit. This PMOS is then controlled by control circuitry to perform the role of providing the required voltage level, for whatever current is required by the load.

Depending on the type of load, the current required by the load may vary. A problem occurs in some known LDO circuits when the load current varies rapidly. This is because the PMOS pass device is generally a relatively slow device, having a slow response to changes in the control signal provided at its gate terminal. This slow response results in the output voltage of the LDO circuit fluctuating, which is undesirable as this generates noise, and causes problems at high frequencies.

In order to minimize the voltage fluctuations at the output of known LDO voltage regulators, an output capacitor is often provided. However, the output capacitor is required to be relatively large in order to adequately minimize voltage fluctuations, for example in the range of 0.5 μF to 10 μF depending on the scale of current variations. The necessity to provide such a large capacitor is disadvantageous as an additional discrete component is required that adds to the cost of manufacturing the device.

BRIEF SUMMARY OF THE INVENTION

One embodiment of the present invention at least partially addresses some of the above-mentioned problems.

According to a first embodiment of the present invention, there is provided a low drop-out DC voltage regulator for regulating a voltage from a DC supply comprising: a pass device controllable to maintain a voltage at an output of the regulator and arranged to provide a first current from the DC supply, at least part of said first current being provided to a load connected to the output of the regulator; and current regulating means connected to said pass device and to the output of the regulator, said current regulating means arranged to conduct a second current controllable such that the first current through said pass device remains constant irrespective of variations in a load current to said load.

According to one embodiment of the present invention, resistance means are provided connected to the pass device and arranged to receive at least part of the first current, the current regulating means being controlled based on a voltage drop across the resistance means.

According to a further aspect of the present invention, there is provided a method of regulating a voltage at the output of a low drop-out DC voltage regulator comprising: controlling a pass device to maintain a voltage at the output of the regulator, the pass device providing a first current from the DC supply, at least part of the first current being provided to a load connected to the output of the regulator; and controlling a current regulating means connected to said pass device to conduct a second current controllable such that the first current through said pass device remains constant irrespective of a load current to said load.

BRIEF DESCRIPTION OF THE SEVERAL VIEWS OF THE DRAWINGS

The foregoing and other purposes, features, aspects and advantages of the invention will become apparent from the following detailed description of embodiments, given by way of illustration and not limitation with reference to the accompanying drawings, in which.

DETAILED DESCRIPTION OF THE INVENTION

Figure 1:
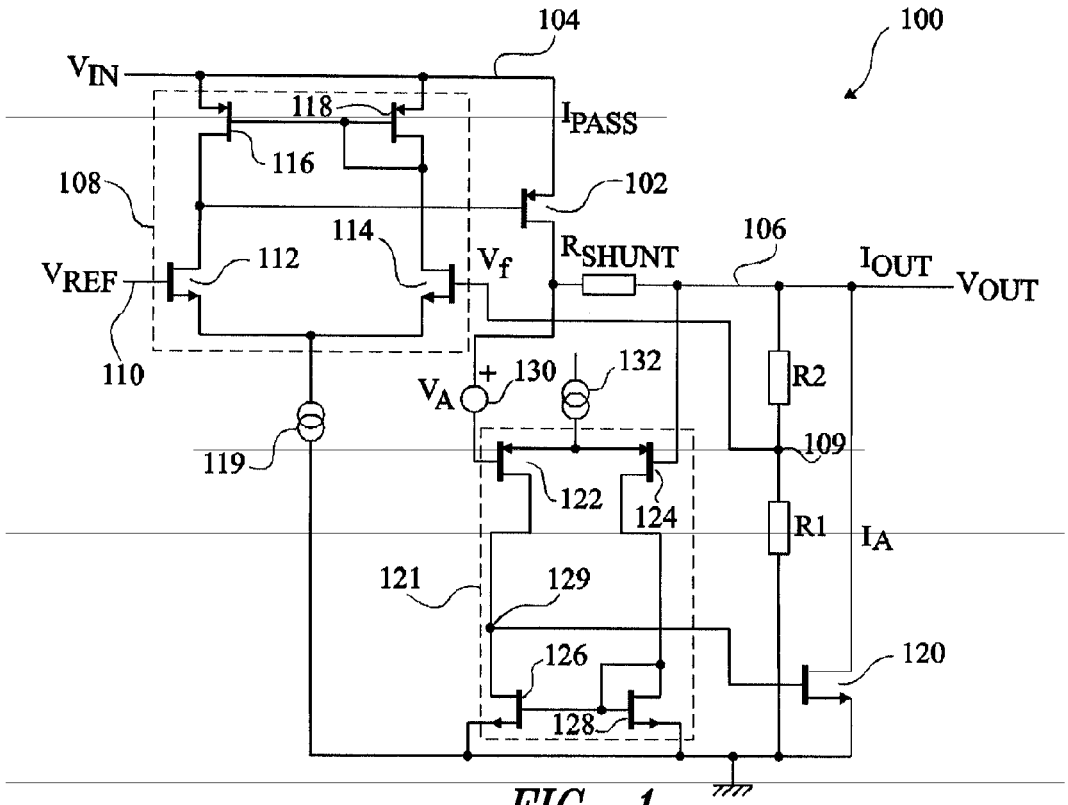
FIGS. 1, 2 and 3 illustrate LDO circuits according to first, second and third embodiments of the present invention respectively.

FIG. 1 illustrates a first embodiment of a low drop-out (LDO) voltage regulating circuit 100. LDO circuit 100 comprises a P-channel MOS transistor (PMOS) 102 having its source terminal connected to an input voltage $V_{IN}$ on line 104 and its drain terminal connected to a first terminal of a shunt resistor $R_{SHUNT}$. The second terminal of the shunt resistor is connected to the output line 106 of the LDO circuit 100. A pass current $I_{PASS}$ flows through PMOS 102 and through the shunt resistor. The output voltage $V_{OUT}$ of the LDO circuit on line 106 in this first embodiment is equal to $V_{IN}$ minus the voltage between the drain and source of PMOS 102, minus the voltage drop across the shunt resistor.

A comparator 108 provides a control signal to the gate terminal of PMOS 102. Comparator 108 receives a feedback voltage $V_f$. Two resistors R1 and R2 are connected in series between the output line 106 and a ground node. A node 109 between resistors R1 and R2 provides the feedback voltage $V_f$. A reference voltage $V_{REF}$ is also provided to comparator 108 on line 110, this voltage indicating the output voltage $V_{OUT}$. $V_{REF}$ could be a fixed voltage if the same output voltage is desired to remain constant, or could be variable to allow the output voltage $V_{OUT}$ of the LDO circuit 100 to be varied during use.

$V_{REF}$ and $V_f$ are provided to the gate terminals of transistors 112, 114 respectively of comparator 108. Transistors 112, 114 are N-channel MOS transistors having their source terminals connected to ground via a current source 119. Drain terminals of transistors 112, 114 are connected to respective drain terminals of further transistors 116, 118. Transistors 116, 118 are P-channel MOS transistors having their source terminals connected to line 104. The gates of transistors 116, 118 are connected together and to a node between the drain terminals of transistors 114, 118. The gate terminal of PMOS 102 is connected to the node between the drain terminals of transistors 112, 116.

According to this first embodiment, an N-channel MOS transistor (NMOS) 120 is connected between the output line 106 and ground that conducts a current $I_A$. The drain terminal of NMOS 120 is connected to the output line 106 and the source terminal of NMOS 120 is connected to ground. A comparator 121 comprises four transistors 122, 124, 126, 128, for providing a control voltage to the gate terminal of NMOS 120. Comparator 121 compares the voltage drop across the shunt resistor $R_{SHUNT}$ with a reference voltage $V_A$ and varies the control signal to NMOS 120 such that the voltage across the shunt resistor is relatively constant, and equal to $V_A$. A voltage source 130 providing voltage $V_A$ is connected between the first terminal of the shunt resistor and the gate terminal of transistor 122. The gate terminal of transistor 124 is connected to the output line 106, and thus to the second terminal of the shunt resistor. Transistors 122, 124 are P-channel MOS transistors having their source terminals connected together and to a common current source 132, and their drain terminals connected to the drain terminals of transistors 126, 128 respectively. Transistors 126, 128 are N-channel MOS transistors having their source terminals connected together and to a ground node. Furthermore, the gate terminals of transistors 126, 128 are connected together and to the node between the drain terminals of transistors 124, 128. The node 129 between the drain terminals of transistors 122, 126 is connected to the gate terminal of NMOS 120.

In operation, comparator 108 provides a control signal to the gate terminal of PMOS 102 controlling PMOS 102 such that the feedback voltage $V_f$ equals the reference voltage $V_{REF}$, resulting in the output voltage $V_{OUT}$. At the same time, comparator 121 provides a control signal to the gate terminal of NMOS 120 such that the voltage drop across $R_{SHUNT}$ is equal to $V_A$, thus ensuring that the current through $R_{SHUNT}$, and thus also through PMOS 102, remains relatively constant. When the load current changes rapidly, for example in a step from 2 mA to 10 mA, the voltage across $R_{SHUNT}$ will suddenly increase above $V_A$. This will in turn cause transistor 124 of comparator 121 to conduct more than transistor 122, causing the voltage at the drain terminals of transistors 122, 126 to decrease and thus providing a lower voltage at the gate terminal of NMOS 120. The current $I_A$ through NMOS 120 will thus drop, and more of the pass current $I_{PASS}$ through PMOS 102 will be provided to the load at the output line 106. This effect will continue until the load current has been satisfied, and the voltage across the shunt resistor has returned to $V_A$. NMOS 120 being a relatively fast device compared to PMOS 102, an increase in load current can therefore be compensated much more quickly than if PMOS 102 alone responded. Likewise, a rapid reduction in load current will result in an increased voltage $V_{OUT}$ at the output of the LDO circuit, which can be quickly compensated by control of NMOS 120 such that more current $I_A$ is conducted to ground.

According to the embodiment of FIG. 1, NMOS 120 is arranged to conduct a current $I_A$ to ground thus reducing the current $I_{PASS}$ such that the output current $I_{OUT}$ matches the load current. Thus $I_{PASS}$ is preferably at least as high as the highest load current desired by the load, and the value of $R_{SHUNT}$ and $V_A$ are preferably selected to provide $I_{PASS}$ accordingly. For example, if the highest load current desired is 20 mA, a resistance value of 5 ohms could be chosen for $R_{SHUNT}$, and $V_A$ could be chosen to be 0.1 V to maintain the pass current at 20 mA. The value of $R_{SHUNT}$ is preferably chosen to be relatively low, for example less than 10 ohms, to prevent a large voltage drop, as the voltage drop across this resistor combined with the source-drain voltage across PMOS 102 together define the minimum voltage drop achievable by the LDO circuit 100.

Figure 2:
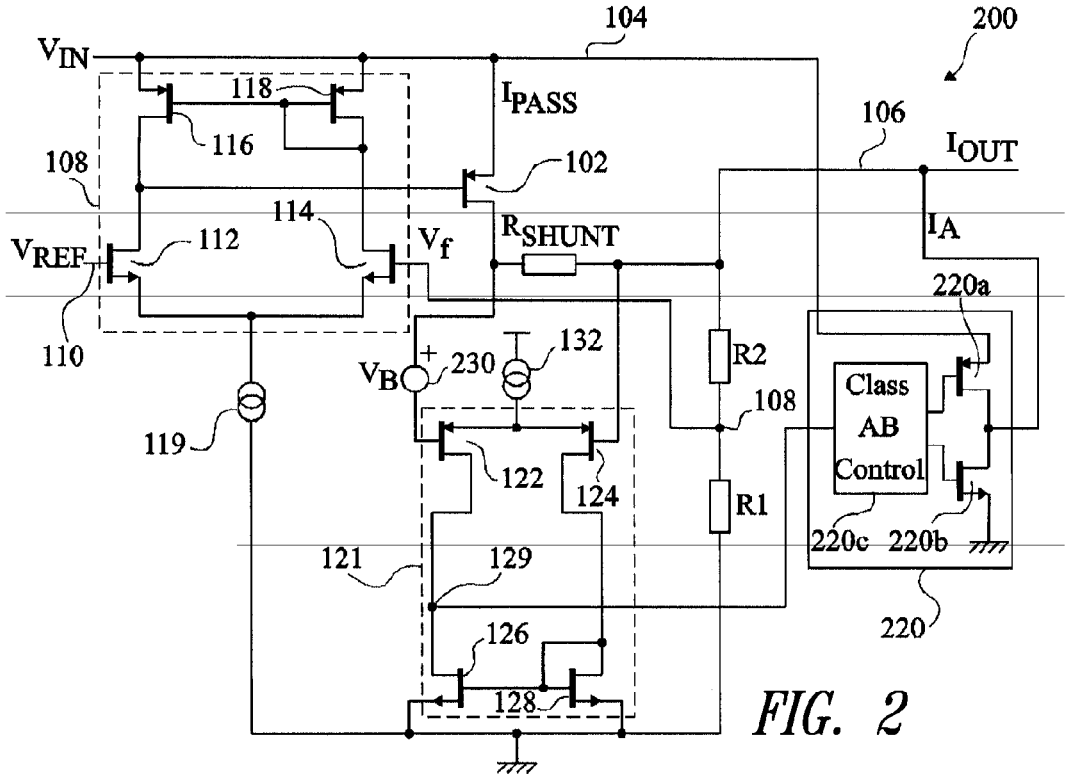

FIG. 2 illustrates an alternative embodiment of an LDO circuit 200. A large proportion of the circuitry of LDO circuit 200 is the same as the circuitry of LDO circuit 100 of FIG. 1, and the common parts have been labeled with the same reference numerals and will not be described again in detail. In LDO circuit 200, NMOS 120 is replaced by a current control block 220 comprising a pair of transistors PMOS 220*a* and NMOS 220*b*, and a class AB control block 220*c*. The drain terminals of transistors 220*a*, 220*b* are connected together and to the output line 106. The source terminal of PMOS 220*a* is connected to $V_{IN}$ on line 104. The source terminal of NMOS 220*b* is connected to ground. The gate terminals of transistors 220*a*, 220*b* are connected to respective output lines of the class AB control block 220*c*. Class AB control block 220 also comprises an input line connected to node 129 between the drain terminals of transistors 122, 126, and thus receives an input voltage signal from comparator 121.

The voltage source 130 of FIG. 1 is replaced in the circuit of FIG. 2 by a voltage source 230 providing a voltage $V_B$ between the gate of transistor 122 and the first terminal of the shunt resistor.

Operation of LDO circuit 200 of FIG. 2 is similar to that of LDO circuit 100, except that current control block 220 allows current to be either routed from the output line 106 to ground, or provided to output line 106 from the supply line 104. Thus whereas in the circuit of FIG. 1 current $I_A$ always flows from the output line 106 through NMOS 120 to ground, in the circuit of FIG. 2 current $I_A$ can either flow from output line 106 through NMOS 220*b* to ground, or from the supply line 104 through PMOS 220*a* to output line 106, and in particular to the load.

Comparators 108, 121 function in the same way as described in relation to FIG. 1, except that voltage $V_B$ provided by the voltage source 230 is lower than $V_A$ of the LDO circuit 100, and preferably results in a current through the shunt resistor, and therefore also through PMOS 102, that is half way between the highest and lowest load currents desired by the load. For example, if the maximum load current desired is 50 mA, and the minimum is 10 mA, the pass current is preferably maintained at approximately 30 mA. If $R_{SHUNT}$ is for example chosen to be 5 ohms, $V_B$ is preferably therefore selected to be 0.15 V. In alternative embodiments however, $V_B$ could also be selected to be at a different value, depending on how the LDO circuit is to be loaded.

Class AB control block 220*c* comprises circuitry for generating the appropriate control signals for driving transistors 220*a* and 220*b* based on the voltage at node 129. Type class AB circuits are generally well known, and variations in their design and operation are possible. In the present case, class AB control block 220 is preferably arranged to control both PMOS 220*a* and NMOS 220*b* with voltage signals that follow changes in the voltage at node 129, in other words such that when the voltage at node 129 increases, the voltage provided to the gate of PMOS 220*a* and/or NMOS 220*b* increases, and when the voltage at node 129 decreases, the voltage at the gate of PMOS 220*a* and/or NMOS 220*b* decreases. The particular voltage levels provided to the gate terminals of PMOS 220*a* and NMOS 220*b* will depend on the particular characteristics of each device, and the supply voltage $V_{IN}$ on line 104. In one example, the voltage $V_{Gb}$ at the gate of NMOS 220*b* is equal to the voltage $V_c$ at node 129, and the voltage $V_{Ga}$ at the gate of PMOS 220*a* is as follows:

$$V_{Ga}=V_c+V_{IN}-2V_T,$$

where $V_c$ is the voltage at node 129, and $V_T$ is the absolute value of the threshold voltage of PMOS 220*a* and NMOS 220*b*. Preferably both PMOS 220*a* and NMOS 220*b* do not conduct at the same time, as this would imply that current is flowing from supply line 104 through NMOS 220*a* and PMOS 220*b* straight to ground.

LDO circuit 200 is advantageous in that the current through PMOS 102 does not need to be maintained at a high level, but can instead be maintained at a lower level, thus reducing the power consumption of the circuit. The circuit still includes an NMOS transistor for regulating the current, providing a fast response to changes in the output voltage $V_{OUT}$. In particular, if the load current is increased from a value of $I_A$ below $I_{PASS}$, to a value above $I_{PASS}$, the output current $I_{OUT}$ can be quickly increased to $I_{PASS}$ by the control of NMOS 220*b*, which will stop conducting an thus prevent $I_A$ conducting to ground. The increase from $I_{PASS}$ to the desired current level is provided by PMOS 220*a*, which is controlled at the same time to conduct current from supply line 104. If, on the other hand, the output current is to be rapidly reduced, this can be achieved quickly by control of NMOS 220*b*, which will quickly increase the current $I_A$ routed to ground.

Figure 3:
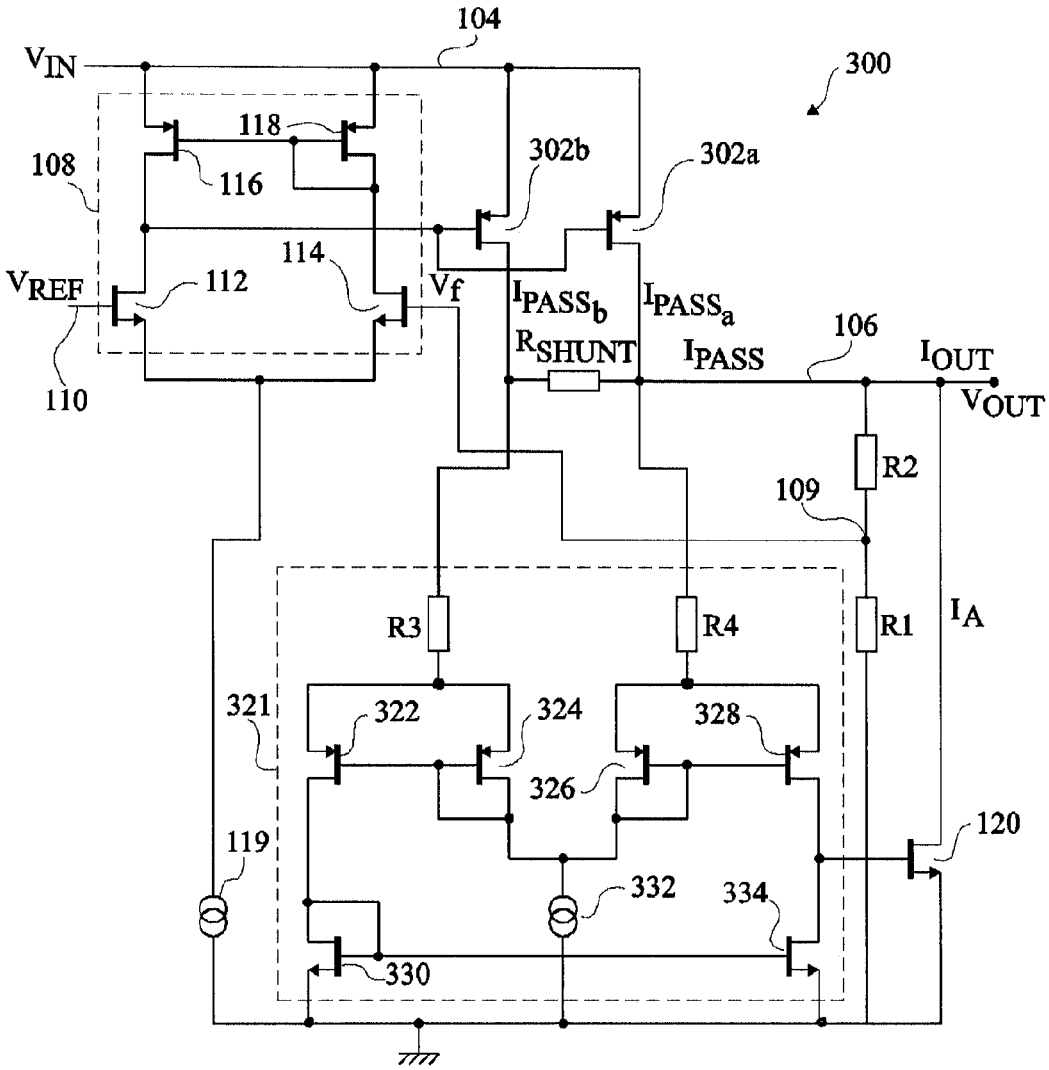

FIG. 3 illustrates an alternative embodiment of an LDO circuit 300. LDO circuit 300 comprises many of the same circuit elements as LDO circuit 100 of FIG. 1, and the common parts have been labeled with the same reference numerals and will not be described again in detail. As shown in FIG. 3, PMOS 102 is replaced by PMOS transistors 302*a* and 302*b*, each connected in the same way as PMOS 102, with their source terminals connected to supply line 104, and their gate terminals connected to the node between the drain terminals of transistors 116 and 112. PMOS 302*a* is a larger device than PMOS 302*b*, and thus conducts more current. In the present example, PMOS 302*a* is approximately 50 times larger than PMOS 302*b*, such that $I_{PASSa}$ through PMOS 302*a* is approximately 50 times greater than $I_{PASSb}$ though PMOS 302*b*. The drain terminal of PMOS 302*a* is connected directly to the output line 106, whereas the drain terminal of PMOS 302*b* is connected to the first terminal of the shunt resistor $R_{SHUNT}$. The second terminal of $R_{SHUNT}$ is connected to output line 106. In this way, the current through $R_{SHUNT}$ is approximately 50 times less than the total pass current $I_{PASS}$, which is equal to $I_{PASSa}+I_{PASSb}$. The shunt resistor $R_{SHUNT}$ of FIG. 3 can thus have a resistance approximately 50 times larger than the shunt resistor $R_{SHUNT}$ of FIG. 1, for the same voltage drop across this resistor. Alternatively, $R_{SHUNT}$ of FIG. 3 could have the same resistance as $R_{SHUNT}$ of FIG. 1, and would thus cause a much lower voltage drop. In alternative embodiments, different ratios between the PMOS pass devices 302*a*, 302*b* could be chosen.

As with LDO circuit 100 of FIG. 1, NMOS 120 in FIG. 3 is controlled by regulating the voltage drop across $R_{SHUNT}$, however an alternative comparator circuit 321 is provided in place of comparator 121. Comparator 321 comprises resistors R3 and R4 with their first terminals connected to the first and second terminals of $R_{SHUNT}$ respectively. These resistors preferably have relatively high resistance values such that current through these resistors is kept low. The second terminal of R3 is connected to the source terminals of transistors 322, 324. Transistors 322, 324 are P-channel MOS transistors having their gate terminals connected together. The second terminal of R4 is connected to the source terminals of transistors 326, 328. Transistors 326, 328 are P-channel MOS transistors having their gate terminals connected together. The drain terminal of transistor 322 is connected to the drain terminal of an N-channel MOS transistor 330. The gate terminal of transistor 330 is connected to its drain terminal, and its source terminal is connected to ground. The drain terminal of transistor 324 is connected to its gate terminal and to a current source 332. Likewise, the drain terminal of transistor 326 is connected to its gate terminal and to the current source 332. The drain terminal of transistor 328 is connected to the drain terminal of a further NMOS transistor 334, which has its gate terminal connected to the gate terminal of transistor 330, and its source terminal connected to ground. The gate terminal of NMOS 120 is connected to the drain terminals of transistors 334 and 328.

In operation, comparator 321 of FIG. 3 operates in a similar fashion to comparator 121 of FIG. 1, in that a relatively constant voltage is maintained across the shunt resistor $R_{SHUNT}$. However, comparator 321 comprises resistors R3 and R4 of different values to provide the desired voltage difference across the shunt resistor, rather than a voltage source 130. For example, in one embodiment R3 is equal to approximately 2500 ohms and R4 is equal to approximately 250 ohms. If, for example, the output current $I_{OUT}$ increases, the current $I_{PASS}$ will also increase, causing an increase in the voltage across the shunt resistor $R_{SHUNT}$. In consequence, the current through transistors 326 and 328 will decrease, and the current through transistors 322 and 324 will increase. This causes the voltage at the gate of transistor 120 to drop, thus reducing the current $I_A$. This reduces the increase in current $I_{PASS}$, in other words keeping $I_{PASS}$ constant.

An advantage with comparator 321 of FIG. 3 is that no part of this comparator needs to be connected to a supply source that is higher than the voltage $V_{IN}$ at the supply line 104.

Thus LDO circuitry has been described having a pass device controlled to control the voltage at the output of the LDO circuit, and a current regulating device for regulating the current through the pass device such that the current remains relatively constant. By providing a pass device that is used to control the voltage at the output of the device, and a separate current regulating means, an improved response time can be achieved. Preferably the current regulating means comprises a transistor that has a relatively fast response time when compared to the pass device. For example, the current regulating means comprises an n-channel MOS transistor or an NPN bipolar junction transistor.

Embodiments of LDO voltage regulators as described herein can for example be implemented in integrated circuit boards and used in a wide range of devices in which a rapid LDO regulating circuit is desired.

Advantageously according to one embodiment of the present invention a PMOS transistor is used as the pass device. A PMOS device can be controlled at its gate terminal with a voltage that is lower than the voltage at its source terminal (connected to the supply voltage), and therefore small voltage drops can be provided by the LDO voltage regulator with no extra circuitry being required to achieve a gate voltage that is higher than the supply voltage.

The current regulating device is preferably controlled based on maintaining the voltage drop across a resistor connected between the pass device and the output of the regulator. In certain embodiments, the pass device comprises a plurality of PMOS transistors connected in parallel, one of these PMOS transistors connected directly to the output of said LDO circuit and arranged to receive a comparatively large proportion of the pass current, and the other connected to the resistor. The resistor thus receives a relatively smaller portion of the pass current, and will cause a smaller voltage drop at the output of the LDO circuit.

Whilst a number of specific embodiments of LDO circuits have been described, it will be apparent that there are various modifications that could be applied. In particular, in alternative embodiments, the features described above in relation to any of the embodiments could be combined in any combination.

Examples have been described in which the pass device and current regulating means comprise MOS transistors, for example MOSFETs. The principles of the present invention apply equally to bipolar junction transistors as they do to MOS transistors, and in particular an NPN bipolar junction transistor has a faster response time than a PNP bipolar junction transistor. In alternative embodiments, one or more PMOS, NMOS or alternative transistors such as NPN or PNP bipolar junction transistors could be used as the pass device 102, 302*a*, 302*b*, or the current regulating device 120, 220*a*, 220*b*. Furthermore, in the embodiments of FIGS. 1, 2 and 3, some or all of the NMOS transistors could be replaced by NPN bipolar transistors, and some or all of the PMOS transistors could be replaced by PNP bipolar transistors. Whilst not shown in the figures, in some embodiments one or more small capacitors could be provided at the output of the LDO circuit for providing further voltage fluctuation compensation. Alternative comparator circuits could also be used.

In some embodiments the voltage sources 130, 230 of FIGS. 1 and 2 and the resistance values of resistors R3 and R4 of FIG. 3 are variable such that the pass current $I_{PASS}$ can be varied during use of the LDO circuit.

Figure 4:
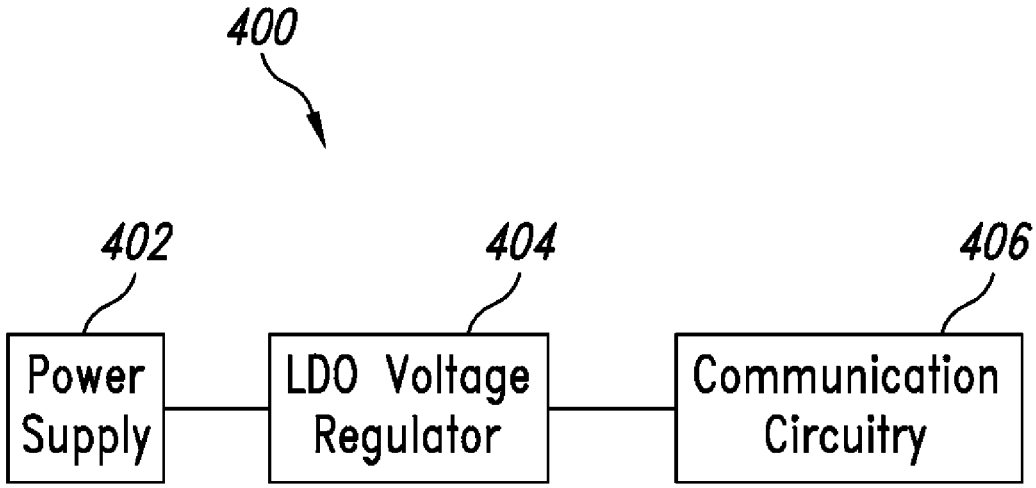
FIG. 4 illustrates a portable electronic device according to one embodiment of the invention.

LDO voltage regulators are commonly employed in various devices, particularly in portable devices, such as laptop computers, mobile telephones, and personal digital assistants (PDA). Shown in FIG. 4 is a portable device 400 that includes a power supply (e.g., a battery) 402; an LDO voltage regulator 404, such as one of the LDO voltage regulators 100, 200, 300; and communication circuitry 406. The power supply 402 supplies the input voltage $V_{IN}$ to the LDO voltage regulator 404, which supplies the regulated output voltage $V_{OUT}$ to the communications circuitry acting as the load discussed above. It will be appreciated that the "load" could also be various other components of the portable device 400, such as processing circuitry, memory, etc.

Having thus described at least one illustrative embodiment of the invention, various alterations, modifications and improvements will readily occur to those skilled in the art. Such alterations, modifications and improvements are intended to be within the scope of the invention. Accordingly, the foregoing description is by way of example only and is not intended to be limiting. The invention is limited only as defined in the following claims and the equivalent thereto.

The invention claimed is:

1. A voltage regulator, comprising:

an input;

a pass device coupled to the input and configured to pass a first current;

an output coupled to the pass device and configured to provide a load current, the load current including at least part of the first current; and a current regulator, coupled to said pass device and to the output of the voltage regulator, wherein the pass device and the current regulator are configured to maintain a voltage at the output of the voltage regulator and the current regulator is configured to cause the first current through said pass device to remain relatively constant during variations in the load current.

2. The voltage regulator of claim 1 wherein said pass device comprises one of a P-channel MOS transistor and a PNP bipolar junction transistor, and said current regulator comprises one of an N-channel MOS transistor and an NPN bipolar junction transistor.

3. The low voltage regulator of claim 1, further comprising:

a resistance coupled between the pass device and the output of the voltage regulator and configured to receive at least part of the first current; and a controller configured to control the current regulator based on a voltage drop across the resistance.

4. The voltage regulator of claim 3 wherein said current regulator comprises a transistor and said controller comprises a comparator coupled to first and second terminals of said resistance and to a control terminal of said transistor, said comparator being configured to provide a control signal to the control terminal of said transistor for controlling a second current.

5. The voltage regulator of claim 1, further comprising a comparator coupled to the output of the voltage regulator for controlling the pass device.

6. The voltage regulator of claim 1 wherein the first current comprises a load current to a load coupled to the output of the voltage regulator and a second current through said current regulator.

7. The voltage regulator of claim 1 wherein said current regulator is operable to provide a second current to said load or to receive said second current from said pass device.

8. The voltage regulator of claim 7 wherein said current regulator comprises a first transistor and a second transistor, said first transistor being coupled to a high voltage level and the second transistor being coupled to a low voltage level.

9. The low drop-out DC voltage regulator of claim 7 wherein said current regulator comprises a first transistor and a second transistor, said first transistor being coupled to a high voltage level and the second transistor being coupled to a low voltage level.

10. A device, comprising:

a load; and an integrated circuit comprising a voltage regulator configured to provide a load current to the load, the integrated circuit including:

a pass device configured to pass a first current, wherein the load current includes at least part of the first current; and a current regulator, coupled to said pass device and to the load, wherein the pass device and the current regulator are configured to maintain a voltage at the load and the current regulator is configured to cause the first current through said pass device to remain relatively constant irrespective of variations in the load current.

11. The device of claim 10 wherein said pass device comprises one of a P-channel MOS transistor and a PNP bipolar junction transistor, and said current regulator comprises one of an N-channel MOS transistor and an NPN bipolar junction transistor.

12. The device of claim 10, further comprising:

a resistance coupled between the pass device and the load and arranged to receive at least part of the first current; and a controller configured to control the current regulator based on a voltage drop across the resistance.

13. The device of claim 12 wherein said current regulator comprises a transistor and said controller comprises a comparator coupled to first and second terminals of said resistance and to a control terminal of said transistor, said comparator being arranged to provide a control signal to the control terminal of said transistor for controlling a second current.

14. The device of claim 10, further comprising a comparator coupled to the load and configured to control the pass device.

15. The device of claim 10 wherein the first current comprises the load current and a second current through said current regulator.

16. The device of claim 10 wherein said current regulator is operable to provide a second current to said load or to receive said second current from said pass device.

17. The device of claim 16 wherein said current regulator comprises a first transistor and a second transistor, said first transistor being coupled to a high voltage level and the second transistor being coupled to a low voltage level.

18. The device of claim 10 wherein the device is a portable communication device and the load includes communications circuitry supplied by the voltage regulator.

19. A method, comprising:

regulating a voltage at an output of a low drop-out DC voltage regulator, the regulating including:

controlling a pass device to maintain a voltage at the output of the regulator, the pass device providing a first current, at least part of the first current being provided to a load coupled to the output of the regulator; and controlling a current regulator coupled to said pass device to conduct a second current to maintain the first current through said pass device at a relatively constant level irrespective of a load current to said load.

20. The method of claim 19 wherein said current regulator is controlled based on the voltage drop across a resistance coupled between said pass device and the output of said voltage regulator.

21. A low drop-out DC voltage regulator, comprising:

an input configured to receive a supply voltage;

an output configured to provide a regulated output voltage to a load;

a pass device coupled between the input and an intermediate node;

a resistance coupled between the intermediate node and the output;

a switch element coupled between the output and a supply terminal; and a control circuit coupled to the switch element and the resistance, the control circuit being structured to control the switch element based on a voltage across the resistance.

22. The low drop-out DC voltage regulator of claim 21 wherein said pass device comprises one of a P-channel MOS transistor and a PNP bipolar junction transistor, and said switch element comprises one of an N-channel MOS transistor and an NPN bipolar junction transistor.

23. The low drop-out DC voltage regulator of claim 21 wherein said switch element comprises a transistor and said control circuit comprises a comparator coupled to first and second terminals of said resistance and to a control terminal of said transistor, said comparator being arranged to provide a control signal to the control terminal of said transistor based on the voltage across the resistance.

24. The low drop-out DC voltage regulator of claim 23, wherein the comparator comprises:

first and second resistors respectively coupled to first and second terminals of the resistance, the first and second resistors having different resistances with respect to one another; and a comparison circuit having first and second inputs respectively coupled to the second terminals of the first and second resistors, and an output coupled to the control terminal of the transistor, the comparison circuit being structured to provide the control signal based on a comparison of respective currents flowing through the first and second resistors.

25. The low drop-out DC voltage regulator of claim 21 wherein said switch element comprises a first transistor and a second transistor having respective control terminals controlled by the control circuit, said first transistor being coupled between the output and the input and the second transistor being coupled between the output and the supply terminal.

26. A low drop-out DC voltage regulator for regulating a voltage from a DC supply comprising:

a pass device controllable to maintain a voltage at an output of the voltage regulator and arranged to provide a first current from the DC supply, at least part of said first current being provided to the output of the regulator, which is configured to be coupled to a load;

a current regulator, coupled to said pass device and to the output of the voltage regulator, and configured to cause the first current through said pass device to remain relatively constant irrespective of variations in a load current to said load;

a resistance coupled between the pass device and the output of the voltage regulator and configured to receive at least part of the first current; and a controller configured to control the current regulator based on a voltage drop across the resistance, wherein said current regulator comprises a transistor and said controller comprises a comparator coupled to first and second terminals of said resistance and to a control terminal of said transistor, said comparator being configured to provide a control signal to the control terminal of said transistor for controlling a second current.

27. The low drop-out DC voltage regulator of claim 26 wherein said controllable pass device comprises one of a P-channel MOS transistor and a PNP bipolar junction transistor, and said current regulator comprises one of an N-channel MOS transistor and an NPN bipolar junction transistor.

28. The low drop-out DC voltage regulator of claim 26, further comprising a comparator coupled to the output of the voltage regulator for controlling the pass device.

29. The low drop-out DC voltage regulator of claim 26 wherein the first current comprises a load current to a load coupled to the output of the voltage regulator and a second current through said current regulator.

30. The low drop-out DC voltage regulator of claim 26 wherein said current regulator is operable to provide a second current to said load or to receive said second current from said pass device.

31. A device, comprising:

a DC supply;

a load; and an integrated circuit comprising a low drop-out DC voltage regulator that includes:

a pass device controllable to maintain a voltage at an output of the voltage regulator and arranged to provide a first current from the DC supply, at least part of said first current being provided to the output of the voltage regulator, which is configured to be coupled to a load;

a current regulator, coupled to said pass device and to the output of the voltage regulator, and configured to cause the first current through said pass device to remain relatively constant irrespective of variations in a load current to said load;

a resistance coupled between the pass device and the output of the voltage regulator and arranged to receive at least part of the first current; and a controller configured to control the current regulator based on a voltage drop across the resistance, wherein said current regulator comprises a transistor and said controller comprises a comparator coupled to first and second terminals of said resistance and to a control terminal of said transistor, said comparator being arranged to provide a control signal to the control terminal of said transistor for controlling a second current.

32. The device of claim 31 wherein said controllable pass device comprises one of a P-channel MOS transistor and a PNP bipolar junction transistor, and said current regulator comprises one of an N-channel MOS transistor and an NPN bipolar junction transistor.

33. The device of claim 31, further comprising a comparator coupled to the output of the voltage regulator for controlling the pass device.

34. The device of claim 31 wherein the first current comprises a load current to a load coupled to the output of the voltage regulator and a second current through said current regulator.

35. The device of claim 31 wherein said current regulator is operable to provide a second current to said load or to receive said second current from said pass device.

36. The device of claim 35 wherein said current regulator comprises a first transistor and a second transistor, said first transistor being coupled to a high voltage level and the second transistor being coupled to a low voltage level.

* * * * *

UNITED STATES PATENT AND TRADEMARK OFFICE

CERTIFICATE OF CORRECTION

PATENT NO. : 8,044,653 B2
APPLICATION NO. : 11/757865
DATED : October 25, 2011
INVENTOR(S) : Philippe Maige et al.

It is certified that error appears in the above-identified patent and that said Letters Patent is hereby corrected as shown below:

Column 7, Line 55:
Claim "3. The low voltage regulator of claim 1, further comprising:" should read, --3. The voltage regulator of claim 1, further comprising:--.

Signed and Sealed this
Thirty-first Day of January, 2012

David J. Kappos

David J. Kappos
*Director of the United States Patent and Trademark Office*